US012466690B2

(12) United States Patent
Hillenmaier et al.

(10) Patent No.: US 12,466,690 B2
(45) Date of Patent: Nov. 11, 2025

(54) CABLE DRUM SUPPORT FOR ROTATABLY SUPPORTING A CABLE DRUM

(71) Applicant: Wolff & Müller Tief- und Straßenbau Gmbh & Co. KG, Stuttgart (DE)

(72) Inventors: Joachim Hillenmaier, Ingelfingen-Eberstal (DE); Philip Kircher, Asperg (DE); Edgar Baumann, Igersheim / Bernsfelden (DE)

(73) Assignee: WOLFF & MÜLLER TIEF-UND STRASSENBAU GMBH & CO. KG, Stuttgart (DE)

( * ) Notice: Subject to any disclaimer, the term of this patent is extended or adjusted under 35 U.S.C. 154(b) by 170 days.

(21) Appl. No.: 18/257,996

(22) PCT Filed: Dec. 17, 2021

(86) PCT No.: PCT/EP2021/086422
§ 371 (c)(1),
(2) Date: Jun. 16, 2023

(87) PCT Pub. No.: WO2022/129481
PCT Pub. Date: Jun. 23, 2022

(65) Prior Publication Data

US 2024/0051783 A1 Feb. 15, 2024

(30) Foreign Application Priority Data

Dec. 18, 2020 (DE) ..... 20 2020 107 393.1

(51) Int. Cl.
*B65H 49/30* (2006.01)

(52) U.S. Cl.
CPC ..... *B65H 49/305* (2013.01); *B65H 2403/93* (2013.01)

(58) Field of Classification Search
CPC ..... B65H 75/42
See application file for complete search history.

(56) References Cited

U.S. PATENT DOCUMENTS 3,123,314 A 3/1964 Bruestle
4,098,468 A 7/1978 Skalleberg
(Continued)

FOREIGN PATENT DOCUMENTS

CN 2 442 424 Y 8/2001
CN 108 190 612 A 6/2018
(Continued)

OTHER PUBLICATIONS

International Preliminary Report on Patentability for corresponding International Application No. PCT/EP2021/086422 dated Jun. 13, 2023.
(Continued)

*Primary Examiner* — William A. Rivera
(74) *Attorney, Agent, or Firm* — Chrisman Gallo Tochtrop LLC

(57) ABSTRACT

The application relates to a cable drum support for rotatably supporting a cable drum, including a cross beam, on which two holding arms are arranged, which are aligned parallel to one another, wherein each holding arm has a respective laterally protruding and rotatably supported bearing pin on a free end, wherein the bearing pins are arranged aligned with one another on the holding arms so as to face one another and aligned parallel to the cross beam, and wherein at least one of the holding arms is shiftably supported along the cross beam. The cable drum support further including at least one actuatable actuator, which is formed to shift at least the one of the holding arms and/or to apply a torque to at least one bearing pin for rotating about its longitudinal central axis.

13 Claims, 3 Drawing Sheets

(56) References Cited

U.S. PATENT DOCUMENTS

| | | | | |
|---|---|---|---|---|
| 4,252,358 | A | 2/1981 | Klebs | |
| 5,123,602 | A | 6/1992 | Saklleberg et al. | |
| 5,938,392 | A * | 8/1999 | Duck | A01D 87/127 414/24.5 |
| 6,789,995 | B1 | 9/2004 | Manzi et al. | |
| 8,784,007 | B2 * | 7/2014 | Wilson | B09B 1/004 405/129.95 |
| 10,669,119 | B2 * | 6/2020 | Ewing | B65H 75/425 |
| 10,947,079 | B2 * | 3/2021 | Fjetland | B65H 75/425 |
| 11,827,489 | B1 * | 11/2023 | Harrop | B09B 1/004 |
| 11,856,892 | B2 * | 1/2024 | Corriher | A01D 87/127 |
| 2009/0178895 | A1 * | 7/2009 | Vannest | B65H 75/4463 191/12.2 R |
| 2015/0284213 | A1 * | 10/2015 | Chachere | B65H 49/327 242/419.4 |
| 2015/0292282 | A1 * | 10/2015 | Dyck | B65H 75/425 166/385 |
| 2019/0039856 | A1 * | 2/2019 | Summer | B65H 75/425 |
| 2019/0168987 | A1 | 6/2019 | Fjetland | |
| 2024/0116735 | A1 * | 4/2024 | Vavricka | B65H 75/4481 |
| 2024/0400347 | A1 * | 12/2024 | Oliver | E21B 7/02 |

FOREIGN PATENT DOCUMENTS

| | | | |
|---|---|---|---|
| DE | 11 58 142 | A | 11/1963 |
| DE | 690 08 494 | T2 | 8/1994 |
| DE | 27 13 866 | A1 | 10/1997 |
| DE | 600 02 887 | T2 | 5/2004 |
| DE | 20 2011 100 482 | U1 | 8/2012 |
| WO | 2018/038620 | A1 | 3/2018 |

OTHER PUBLICATIONS

International Search Report for corresponding International Application No. PCT/EP2021/086422 mailed Apr. 4, 2022.

Written Opinion for corresponding International Application No. PCT/EP2021/086422 dated Apr. 4, 2022.

* cited by examiner

CABLE DRUM SUPPORT FOR ROTATABLY SUPPORTING A CABLE DRUM

FIELD OF THE INVENTION

The invention relates to a cable drum support for rotatably supporting a cable drum, as it is used in particular on construction sites or site developments. Cable drums of this type can have diameters of several meters and can weigh several tons. The weight is thereby also determined by the cable, which is wound onto the cable drum. If the cable is a power line, for example, comprising a metallic core and an electric insulation, the weight is higher than in the case of a cable, which is formed as media hose, for example, for liquid or gaseous media. In order to safely guide and to use cable drums of this size, cable drum supports are known, on which the cable drums can be rotatably supported safely. Cable drum carriages, which have a chassis on which the cable drum is held, are typically used especially for this purpose. A work machine then has to pull or drag the cable drum carriage behind it in order to unroll the cable wound onto the cable drum. Due to the large weight of a cable carriage of this type, a manual shifting of the carriage or a pivoting of the carriage about a vertical axis is often only possible with difficulty or not at all.

BACKGROUND OF THE INVENTION

Cable drum supports are furthermore known, which can be fastened to a pivotable working arm of the digger. They have a long-extending mandrel or bearing pin, which extends axially farther than the cable drum to be received, which can be pushed onto the mandrel. A relatively quick change can thus be made between different cable drums by means of the construction machine. Due to the mechanical construction, however, particularly high lever forces act on the bearing mandrel, whereby the operability of the cable drum support is made more difficult. This variation additionally demands that a large amount of free space is available for the construction machine in order to maneuver the cable drum.

BRIEF SUMMARY OF THE INVENTION

The invention is thus based on the object of creating an improved cable drum support, which provides for a simple operation in particular by means of available construction machines or work machines, in the case of which a simple reception and discharge of cable drums as well as the safe and rotatable support thereof are ensured.

The object on which the invention is based is solved by means of a cable drum support comprising the features of claim 1. Said cable drum support has the advantage that a cable drum is gripped axially from two sides and is rotatably supported. A continuous bearing mandrel is forgone thereby. Instead, bearing pins can be inserted into front-side openings of the cable drum from two sides, whereby the cable drum is held in an advantageous and balanced manner on the cable drum support. A simple insertion and removal of the bearing pins into the cable drum is made possible thereby. Alternatively or additionally, the cable drum support according to the invention ensures that the received cable drum can be actively rotated by means of the cable drum support, in order to facilitate an unrolling or rolling up.

The cable drum support according to the invention is characterized in that it has a cross beam, on which two holding arms are arranged, which are aligned parallel to one another, wherein each holding arm has a respective laterally protruding and rotatably supported bearing pin on a free end, wherein the bearing pins are arranged aligned with one another on the holding arms so as to face one another and aligned parallel to the cross beam. At least one of the holding arms is thereby shiftably supported along the cross beam. Due to the arrangement of the bearing pins so as to be aligned with and parallel to the cross beam, it is attained that in response to a shifting of at least one of the holding arms along the cross beam, the alignment of the bearing pins is maintained. By pushing the holding arms towards one another and by pushing them away from one another along the cross beam, the bearing pins are thus moved towards one another or away from one another, whereby a cable drum can be received or discharged in that the bearing pins penetrate into corresponding receptacles of the cable drum or are pulled out of them. According to the invention, the cable drum support furthermore has at least one actuatable actuator, which is formed to shift at least the one of the holding arms and/or to apply a torque to at least one of the bearing pins for rotating about its longitudinal central axis. An automated shifting of the holding arms and thus of the distance of the bearing pins from one another is thus made possible by means of the actuator. If the actuator is formed to apply a torque to the at least one bearing pin, a driving of a received cable drum is made possible. An actuator is preferably present in each case for shifting the holding arms as well as for driving the bearing pin, or an actuator is present, which is formed to shift the at least one holding arm as well as to drive the at least one bearing pin.

The cable drum support particularly preferably has a first actuator, which is arranged on the cross beam and which is operatively connected to at least one of the holding arms, in particular to both holding arms, for the purpose of shifting it or them, respectively. The actuator is thus located at the cross beam and serves the purpose of shifting at least the one of the holding arms along the cross beam. The actuator thus represents an integral part of the cable drum support.

Both holding arms can particularly preferably be shifted in opposite directions on the cross beam by means of a gear connected to the first actuator. It is ensured by means of the gear that the holding arms are always shifted in opposite directions along the cross beam, so that, for example by driving only one of the holding arms, the other one of the holding arms is likewise moved along, but in opposite directions. Evenly pushing the holding arms towards one another or away from one another is thus ensured on the cross beam. This in particular has the advantage that the balance of the cable drum support is not negatively affected by a shifting of the holding arms, whereby a safe operation of the cable drum support is ensured.

The cable drum support furthermore preferably has a second actuator, which is operatively connected to the at least one bearing pin, in order to drive the latter to rotate. In this case, a first actuator is in particular present for the holding arms and a second actuator for the bearing pin in this case. A driving of the holding arms independently of the bearing pin is thus possible, whereby in particular operating errors are safely avoided.

The first actuator and/or the second actuator are particularly preferably each formed as hydraulic actuator. The two actuators can thus be hydraulically driven in order to shift the holding arm or holding arms and/or in order to drive the bearing pin or the bearing pins to rotate. The formation as hydraulic actuators results in the advantage that the cable drum support can be integrated in a simple way into existing construction machine systems, which have a hydraulic supply circuit, for example for operating a working arm of the construction machine or, for example, of a tool, which can be fastened to the working arm, such as a spoon, chisel, or the like. Existing drive systems are thus resorted to, whereby the integration of the cable drum support into already existing construction machine systems is possible without high additional costs. According to an alternative embodiment of the invention, at least one of the actuators is formed as electromotive actuator. A precise actuation of the holding arms and/or of the bearing pin is thus also made possible.

The first actuator is particularly preferably formed as hydraulic cylinder. The hydraulic cylinder has a working cylinder comprising a piston, which is shiftably supported therein. The piston is preferably firmly connected to one of the holding arms and the cylinder to the cross beam by means of a piston rod. If a hydraulic pressure is now generated in the working cylinder, the piston is shifted by means of the hydraulic pressure within the working cylinder, and the piston rod or the holding arm, respectively, is thus also shifted along the cross beam. The hydraulic cylinder acts in particular in two working directions, so that the piston can be shifted into the one or into the other direction by applying a pressure on the one or on the other side of the piston within the working cylinder, in order to ensure a pushing together or pushing apart of the bearing pins or of the holding arms, respectively. According to an alternative embodiment, the working cylinder is connected to the one of the holding arms, and the piston to the cross beam. A respective hydraulic cylinder, as it has been described above, is particularly preferably present for each of the holding harms, so that both holding arms can be shifted hydraulically. An additional mechanical gear, which acts between the holding arms and affects the shifting in opposite directions, can thus be forgone.

It is furthermore preferably provided that the second actuator is formed as hydraulic motor. The latter it driven hydraulically and is operatively connected directly or by means of a gear to the at least one bearing pin, in order to convert the hydraulic force into a torque acting on the bearing pin. A corresponding second actuator is preferably assigned to each of the bearing pins, so that both of the bearing pins can be driven hydraulically.

It is furthermore preferably provided that the cable drum support has a first hydraulic system, which has a first hydraulic circuit comprising the first actuator and a second hydraulic circuit comprising the second actuator, and at least one switching valve, by means of which the first hydraulic circuit or the second hydraulic circuit can optionally be connected to a hydraulic connector for a hydraulic supply system. By activating the at least one switching valve, it can thus be set, which of the hydraulic circuits of the first hydraulic system is active, and which one is blocked. It is ensured thereby that only one of the two hydraulic circuits of the first hydraulic system can be used at all times. It is ensured thereby, for example, that in a case, in which a torque is applied to the bearing pin, one of the holding arms cannot simultaneously be driven to increase the distance to the other holding arm. The operational safety of the cable drum support is increased thereby. The hydraulic connector is in particular formed so that it can be connected to a counter connector of the hydraulic supply system. The hydraulic connector can thus be or will be adapted, respectively, to different hydraulic supply systems.

The hydraulic connector is preferably arranged between the arms, in particular centrally on the cross beam—viewed in the longitudinal extension of the cross beam—so that a centralized connection of the first hydraulic system to the hydraulic supply system is made possible. In the region of the hydraulic connector, thus in particular centrally between the arms, the cross beam in particular has a fastening point for fastening the cable drum support to the construction machine, so that the fastening and the hydraulic connection are located close together.

The cable drum support particularly preferably has an activatable coupling for the releasable mechanical fastening of the cable drum support to a working machine, in particular to a working arm of the working machine. The coupling is in particular arranged on the cross beam of the cable drum support, preferably centrally between the holding arms or on the cross beam, respectively, viewed centrally in the longitudinal extension of the cross beam. A simple mechanical connection to the working machine can be established or released by means of the coupling. In particular a simple receiving of the cable drum support by means of a working machine as well as a simple depositing is thus ensured. The coupling is, for example, a quick release or a quick coupling, as they are already used in existing construction machine systems.

The cable drum support particularly preferably has a second hydraulic system, which has a hydraulically drivable third actuator, wherein the activatable coupling is rotatably supported on the cross beam, and wherein, when being actuated, the third actuator is formed to rotate the coupling relative to the cross beam. A pivoting or rotating of the cable drum support about an axis of rotation, which is aligned perpendicular to the longitudinal extension of the cross beam, is thus possible by means of the third actuator. A systematic pivoting of the cable drum support is thus possible during operation.

The second hydraulic system particularly preferably has a second hydraulic connector, which is assigned to the coupling. The second hydraulic connector for the second hydraulic system is thus also arranged close to the coupling and thus to the fastening point on the construction machine, whereby a simple connection during the assembly of the cable drum support to the construction machine is ensured.

The coupling is preferably formed to also establish at least one hydraulic connection between the hydraulic supply system and the first and/or the second hydraulic system during the mechanical fastening of the cable drum support. The coupling thus does not serve for the mechanical connection of the cable drum support to a construction machine, but also for the hydraulic connection. The hydraulic connection is in particular also established or released automatically by activating the coupling. A simple connection of the entire cable drum support to a construction machine is thus ensured mechanically as well as hydraulically.

According to a preferred embodiment of the invention, the first hydraulic system has two switching valves, which connect the first hydraulic circuit to the hydraulic connector only when both switching valves are in a first one of two switching positions. If one of the two switching valves is displaced into a second one of the two switching positions, the first hydraulic circuit cannot be used any longer. It is ensured thereby that the holding arms can be moved towards one another or away from one another only when both switching valves are in the first switching position. An incorrect operation of the cable drum support can be safely prevented thereby. The switching valves are furthermore preferably formed and are connected to the hydraulic circuits in such a way that the second hydraulic circuit can only be used when both switching valves are in the second one of the two switching positions. A torque can thus be applied to the bearing pin only when both switching valves were moved into the second switching position.

The two switching valves are preferably manual switching valves, wherein a respective one of the manual switching valves is arranged on each of the holding arms. The switching valves are thus arranged or can thus be arranged far away from one another on the cable drum support, so that an inadvertent operation of both switching valves is safely prevented. The operational safety of the cable drum support is thus further increased. The two switching valves are in particular in each case located on an outer side of the respective holding arm facing away from the cable drum or from the opposite holding arm, respectively, so that they can be accessed well by a user.

It is furthermore preferably provided that at least one throttle valve is arranged in the second hydraulic circuit. In particular the hydraulic pressure or hydraulic flow provided by the hydraulic supply system can be regulated or influenced, respectively, by the throttle valve, in order to set, for example, the torque acting on the bearing pin and thus the reached rotational speed. The throttle valve is in particular formed as manually operable throttle valve, so that a user can manually set or influence, respectively, the rotational speed of the bearing pin by activating the throttle valve. Two throttle valves are optionally arranged in the second hydraulic circuit, in particular one on each of the holding arms, in order to simplify the setting of the rotational speed or of the torque, respectively, for the user because he can now influence the hydraulic flow for the second hydraulic actuator from both sides of the cable drum support.

According to a preferred further development of the invention, a respective axial protective disk for a cable drum is arranged in a rotationally fixed manner on the respective bearing pin. The axial protective disk ensures that the cable drum can be clamped axially between the two axial protective disks and in particular cannot abut directly with its front side against one of the holding arms and can thus not lead to wear or damages. The outer diameter of the axial protective disks is thereby selected in such a way that it is larger than the inner diameter of the receptacles for the bearing pin or common cable drums.

The respective axial support disk particularly preferably has at least one elastically deformable stop element for a cable drum. The cable drum is advantageously supported in the axial extension between the axial support disks by means of the stop element. Vibrations can thereby also be avoided during operation and a synchronization of the cable drum can be ensured. Each axial support disk particularly preferably has several stop elements, which are arranged so as to be distributed evenly over its circumference, in order to ensure an even application of force of the axial support disk or of the cable drum, respectively. The respective stop element is preferably formed as elastomer element, whereby a cost-efficient realization of the elastically deformable stop element is provided.

BRIEF DESCRIPTION OF THE DRAWINGS

The invention will be described in more detail below on the basis of the drawings, for the purpose of which

DESCRIPTION OF EXAMPLE EMBODIMENTS

Figure 1:
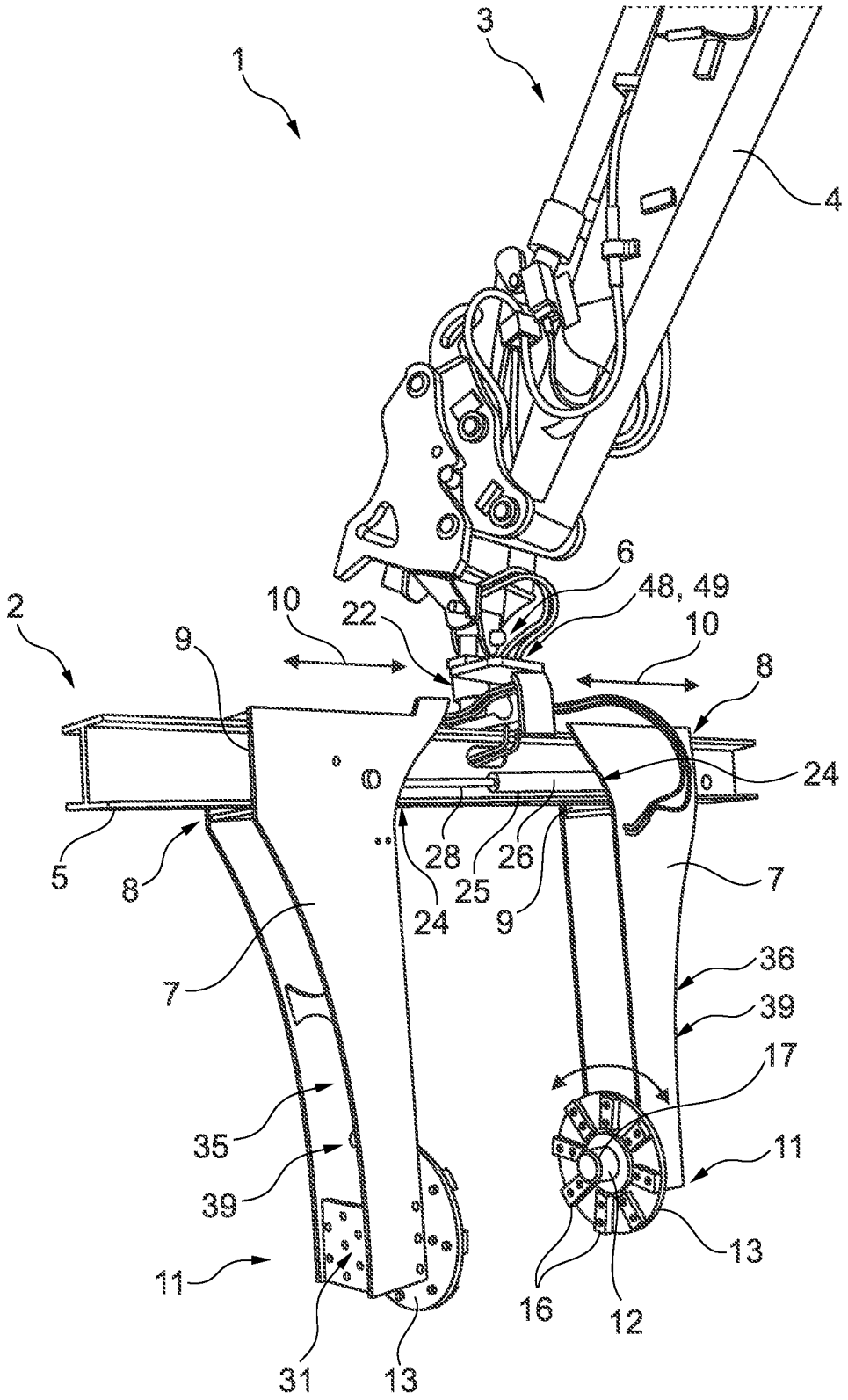
FIG. 1 shows an advantageous cable drum support system in a perspective illustration.

In a perspective illustration, FIG. 1 shows an advantageous cable drum support system 1, which comprises a cable drum support 2 as well as a construction machine 3, which is only shown in sections here, in particular in form of a digger. The construction machine 3 has a movable, in particular hydraulically and/or motor moveable working arm 4, on the free end of which the cable drum support 2 can in particular be releasably fastened.

The cable drum support 2 has a cross beam 5, to which a coupling 6 for releasably fastening the cable drum support 2 to the working arm 4 of the construction machine 3 is centrally fastened. The coupling 6 is in particular arranged centrally, viewed in the longitudinal extension of the cross beam 5, so that in the assembled state the cross beam 5 hangs in a horizontally aligned manner on the working arm 4 in a balanced manner. Two holding arms 7 are supported on the cross beam 5 so as to be shiftable in the longitudinal direction of the cross beam 5. On their end 8 facing the cross beam 5, the holding arms 7 have, for this purpose, a guide opening 9, through which the cross beam 5 protrudes in such a way that the holding arms 7 are supported on the cross beam 5 so as to be shiftable in the longitudinal direction of the cross beam, as indicated by means of double arrows 10 in FIG. 1. According to the present exemplary embodiment, the cross beam 5 is formed as I beam or double-T support, so that it has an outer contour, which differs from a circular shape. The inner contour of the guide opening 9 is formed according to the outer contour of the cross beam 5 or complementary thereto, respectively, so that a positive anti-rotation protection is formed between the cross beam 5 and the respective holding arm 7, which anti-rotation protection prevents that one of the holding arms 7 can be pivoted about the longitudinal axis of the cross beam 5. On the contrary, the support of the holding arms 7 is designed in such a way that they can only be shifted on the cross beam 5 in the longitudinal direction thereof according to the arrows 10. It goes without saying that a bearing play can also be present in other directions of movement, in order to prevent a canting or jamming of the holding arms 7 on the cross beam 5 during the shifting.

On their end 11 facing away from the end 8, the holding arms 7 each have a rotatably supported bearing pin 12. The bearing pins 12 are thereby rotatably supported on the respective holding arm 7 and support an axial support disk 13, which has an outer diameter, which is larger than the outer diameter of the bearing pin 12 itself.

Figure 2:
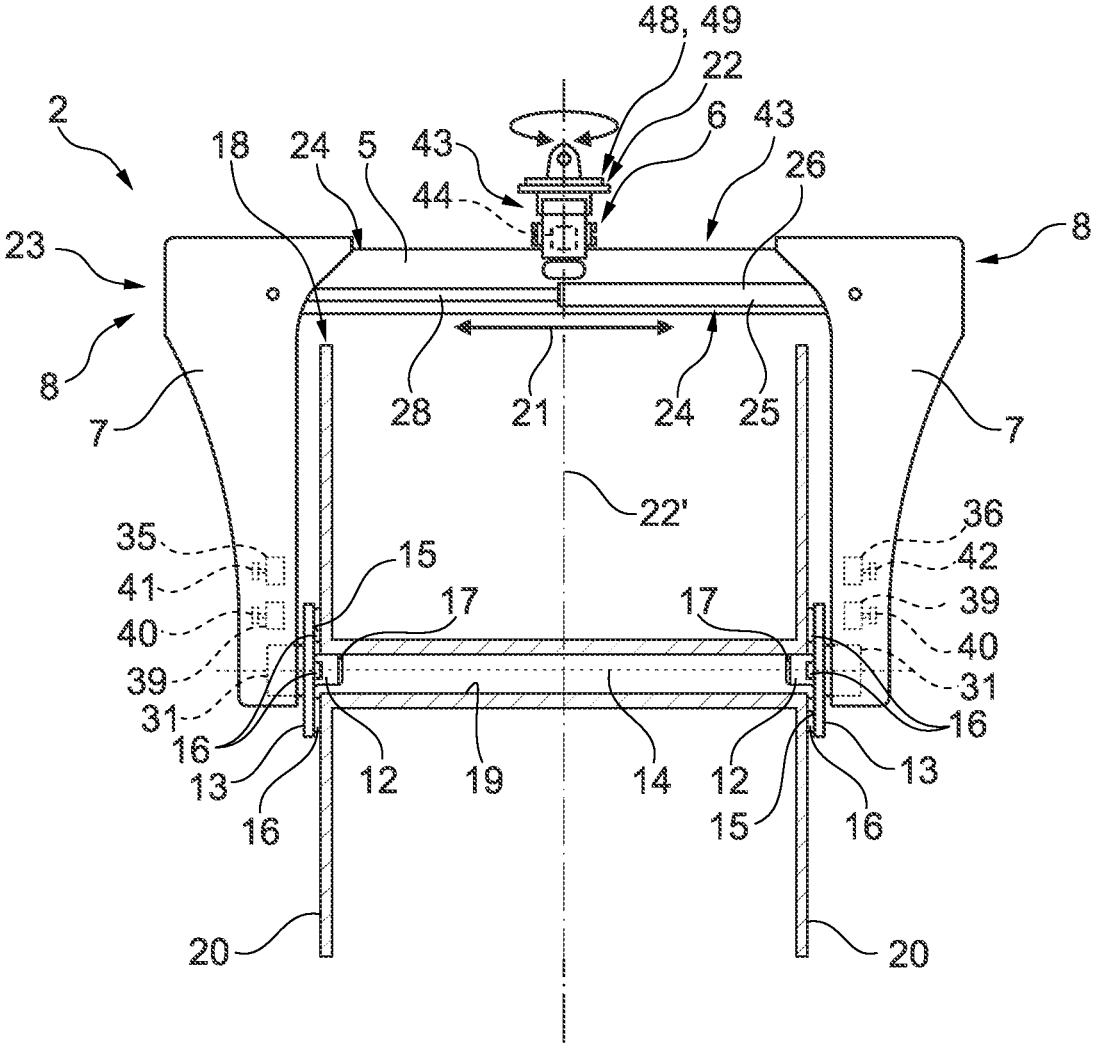
FIG. 2 shows a cable drum support of the cable drum support system in a side view.

In a simplified side view, FIG. 2 shows the cable drum support 2. It can be seen here that the two bearing pins 12 are arranged on the holding arms 7 so as to face one another and so as to be aligned with one another. The bearing pins 12 can thus be rotated about a common imaginary longitudinal central axis or axis of rotation 14. On its end, which faces away from the axial support disk 13 and which faces the opposite bearing pin 12, the respective bearing pin 12 additionally preferably has an insertion phase 17.

The respective axial support disk 13 lies at the end of the bearing pin 12 facing the respective holding arm 7 and, on its front side 15 facing the respective opposite axial support disk 13, supports several stop elements 16, which are arranged so as to be distributed evenly over the circumference and which are in particular formed to be elastically deformable. The stop elements 16 are in particular stop buffers or rubber elements, which serve the purpose of axially abutting against a cable drum to be transported.

A cable drum 18 is additionally illustrated in an exemplary manner in FIG. 2 in a longitudinal section. As do conventional cable drums, the cable drum 18 centrally has a continuous cylindrical receptacle 19, into which, for example, a bearing mandrel or, according to the present exemplary embodiment the respective bearing pin 12 can be axially inserted, in order to thus support the cable drum 18. The cable drum 18 additionally has side walls 20, which prevent that a rolled-up cable can laterally escape from the cable drum 18. Due to the fact that the holding arms 7 are shiftably supported on the cross beam 5, the bearing pins 12 can be moved towards one another or away from one another, as shown by means of a double arrow 21 in FIG. 2. The bearing pins 12 can thus be inserted in a simple way into the receptacle 19 or can be pulled out of the latter, in order to fasten the cable drum 18 to the cable drum support 2 or to release it from the latter. For fastening between the axial support disks 13, in particular between the stop elements 16, the cable drum 18 is thereby preferably held in an axially tensioned manner, so that it is firmly locked to the cable drum support 2. Due to the fact that the bearing pins 12 are rotatably supported on the holding arm 7, a simple unrolling or rolling up of the cable drum 18 arranged thereon is ensured.

The coupling 6, which is centrally arranged on the cross beam 5, in particular has a rotary joint 22, which allows that the cross beam 5 is pivotably supported about an axis of rotation 22', which is aligned perpendicular to the imaginary axis of rotation 14 and thus also perpendicular to the longitudinal extension of the cross beam 5 and represents a vertical axis in particular during operation. A high flexibility during the rolling up or unrolling of the cable is thus made possible during operation.

The cable drum support 2 furthermore has several hydraulically activatable or actuatable actuators, which serve the purpose of applying a torque to the at least one bearing pin 12, to move the holding arms 7 towards one another or away from one another and/or to pivot the cross beam 5 about the axis of rotation 22' on the coupling 16.

Figure 3:
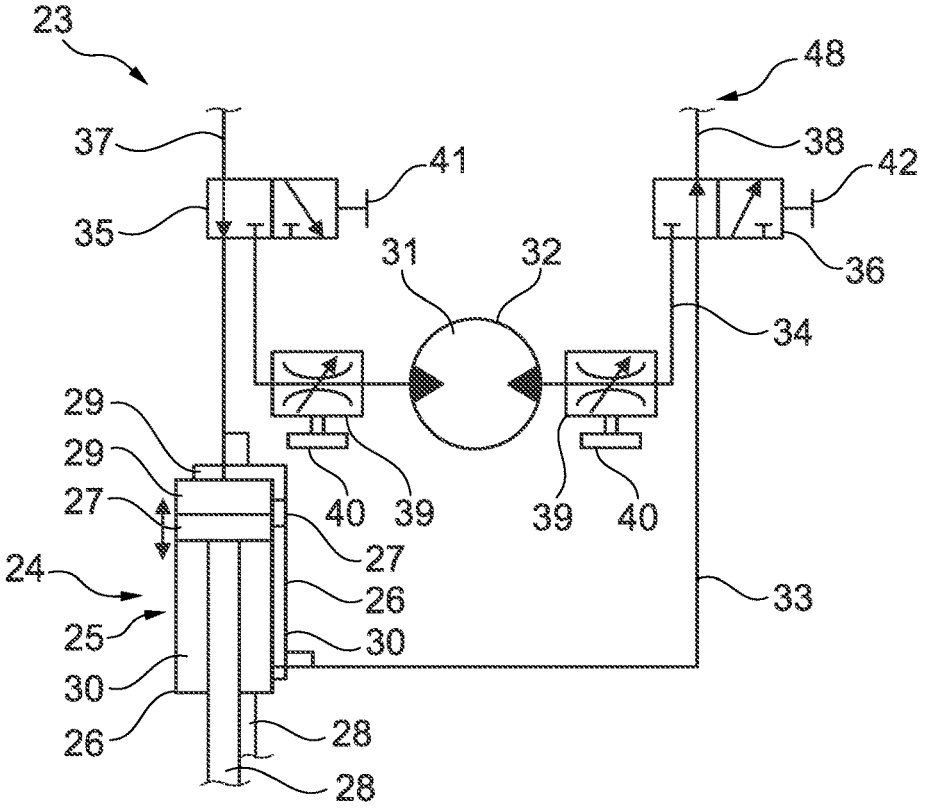
FIG. 3 shows a schematic hydraulic circuit diagram of a first hydraulic system of the cable drum support.

For this purpose, the cable drum support 2 has a first hydraulic system 23, which is shown in a schematic illustration in FIG. 3. The hydraulic system 23 has a first actuator 24, which is operatively connected to the holding arms 7 and which is arranged on the cross beam 5, in order to shift the holding arms 7 along the cross beam 5. For this purpose, the hydraulic actuator 24 is formed as hydraulic cylinder 25, which has a working cylinder 26, in which a piston 27 is supported so as to be shiftable longitudinally, as shown by a double arrow. The piston 27 is connected to one of the holding arms 7 by means of a piston rod 28, which protrudes from the working cylinder 26 on the front side. On its end facing away from the piston rod 28, the working cylinder 26 is firmly connected to the other one of the holding arms 7. Two working chambers 29 and 30, which can be filled with hydraulic medium, are formed in the working cylinder 26 between the piston 27 and the working cylinder 26. Depending on to which one of the two working chambers 29, 30 hydraulic medium is applied, the piston 27 is moved into the one or into the other direction, in order to move the holding arms 7 towards one another or away from one another. It is thereby determined in particular by means of the conveying direction of the hydraulic medium, which is determined by means of the hydraulic supply system, which one of the two working chambers 29, 30 is filled with or to which one hydraulic pressure is applied, respectively. Alternatively, at least one further actuatable or activatable valve means is present, by means of which the hydraulic medium can be applied to the one or the other one of the working chambers 29, 30.

A gear, which safely ensures that the holding arms 7 are shiftably supported on the cross beam 5 only in opposite directions, is optionally switched between the holding arms 7, so that they always have the same distance from the coupling 6 and thus from the center of the cross beam 5. It is ensured thereby that the cable drum support 2 does not become out of balance by means of the shifting of the holding arms 7. According to the present exemplary embodiment, a respective hydraulic cylinder 25 is assigned to each of the holding arms 7. The hydraulic cylinders 25 are thereby arranged on side of the cross beam 5 facing away from one another. The working cylinders 26 are thereby preferably in each case firmly connected to the cross beam 5, and the piston rods 28 to the respective holding arm 7. The hydraulic cylinders 25 are thereby arranged on the cross beam 5 in particular in opposite directions to one another. The hydraulic cylinders 25 are particularly preferably in each case inserted in a lateral depression of the cross beam 5, which is formed by means of the I cross sectional shape of the cross beam 5, so that they are installed on the cable drum support 2 in an installation space-saving manner. For the sake of clarity, the second hydraulic cylinder 25 is only illustrated in a simplified manner in FIG. 3, but likewise integrated into the hydraulic system 23. Due to the arrangement of the hydraulic cylinders 25 in opposite directions on the cross beam 5, the shifting of the holding arms 7 in opposite directions is ensured by means of the hydraulic system 23.

The hydraulic system 23 furthermore has at least one hydraulic motor 31, which forms a second hydraulic actuator 32 of the cable drum support 2 and which is assigned to one of the bearing pins 12 and is operatively connected directly to the latter in a rotationally fixed manner or by means of a gear. Depending on the conveying direction of the hydraulic medium, the bearing pin 12 is thereby driven into the one or into the other direction for rotating purposes. The conveying direction is in particular dependent on the hydraulic supply system. Alternatively, at least one valve or switching means is preferably present in the hydraulic system 23, by means of which a flow direction reversal can be set independently of the hydraulic supply system.

According to the present exemplary embodiment, the first hydraulic cylinders 25 are arranged in a first hydraulic circuit 33, and the hydraulic motor 31 in a second hydraulic circuit 34 of the hydraulic system 23. In the present case, the two hydraulic circuits 33, 34 are in each case connected to two switching valves 35, 36. On the input side, the one switching valve 35 is thereby connected to a hydraulic supply line 37, and, on the output side, the other one of the switching valves 36 is connected to a hydraulic return line 38. The two switching valves 35, 36 are in each case formed as ⅔-way valves, thus as switching valves, which have two switching positions and three connections. One of the connections is in each case provided for the supply line 37 or for the return line 38, respectively. A second connector of the switching valve 35 is connected to the first hydraulic circuit 33 as well as a second connector of the switching valve 36. A third connector of the switching valves 35 or 36, respectively, is thereby in each case connected to the second hydraulic circuit 34. In the first switching position, as shown in FIG. 3, the switching valve 35 connects the supply line 37 to the first hydraulic circuit 33, and the switching valve 36 connects the hydraulic circuit 33 to the return line 38. The first hydraulic circuit 33 is thus activated in this case.

In a second switching position, the switching valve 35 connects the supply line 37 to the second hydraulic circuit 37, and the switching valve 36 connects the hydraulic circuit 34 to the return line 38. If the two switching valves 35, 36 are thus in the second switching position, the second hydraulic circuit 34 is hydraulically connected to feed line or supply line 37 and return line 38, respectively, and is thus activated.

If one of the switching valves 35, 36 is activated in such a way that one of the switching valves 35, 36 is in the first switching position, and the other one of the switching valves is in the second switching position, none of the hydraulic circuits 33, 34 can be operated, and the cable drum support 2 is preferably hydraulically blocked.

It is attained by means of the switching valves 35, 36 that a shifting of the holding arms 7 is made possible or effected, respectively, only when both switching valves 35, 36 are in the first switching position. The safety against the incorrect operation and an unwanted release of the cable drum 18 from the cable drum support 2 is safely ensured therewith.

Connected upstream of and/or downstream from the hydraulic motor 31, the second hydraulic circuit 34 optionally has a throttle valve 39, by means of which the hydraulic flow in the second hydraulic circuit 34 can be influenced, in order to be able to set the rotational speed of the hydraulic motor 31 independently of the present hydraulic pressure of a hydraulic supply system, in particular of the construction machine 3. The throttle valves 39 are in particular arranged on the holding arms 7 as manually activatable throttle valves, so that a user can manually activate the respective throttle valve 39 by activating a respective handle 40.

The switching valves 35, 36 are likewise preferably formed as manually activatable switching valves, to which a handle 41 or 42 is assigned, respectively, by means of which the switching valves 35, 36 can be displaced from the one into the other switching position. The handles 41, 42 are also preferably arranged on the holding arms 7, in particular close to the end 11 of the holding arms 7 on the outer side of the holding arms 7, thus on the side facing away from the opposite holding arm 7, so that they can be reached and activated easily by a user.

Figure 4:
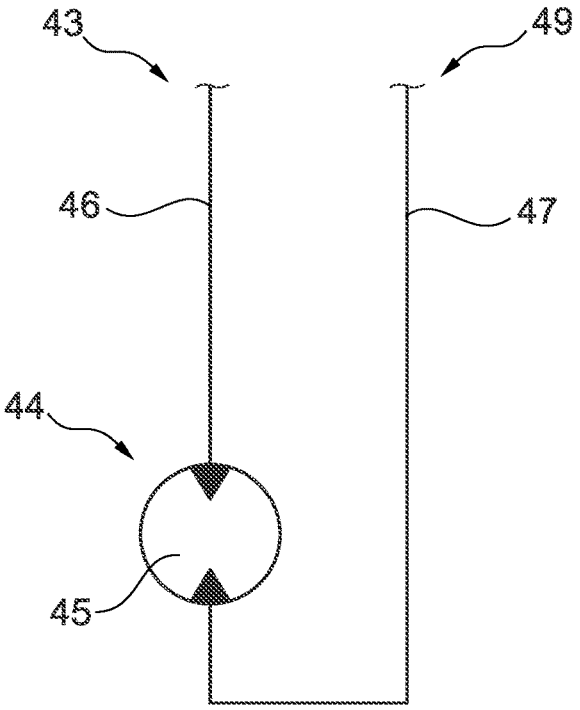
FIG. 4 shows a schematic hydraulic circuit diagram of a second hydraulic system of the cable drum support.

The cable drum support 2 preferably has a second hydraulic system 43, which is shown schematically in FIG. 4. The second hydraulic system 43 has a further actuator 44 in the form of a hydraulic motor 45, which is assigned to the coupling 6, in particular to the rotary joint 22 of the coupling. The actuator 44 is thereby formed for the purpose of rotating the cross beam 5 about the axis of rotation 22' relative to the coupling 22, if necessary, as is indicated by means of a double arrow in FIG. 2. The hydraulic motor 45 is thereby hydraulically connected to a supply line 46 and a return line 47.

The supply lines 37, 46 and the return lines 38, 47 in each case end on a connector 48, 49 on the coupling 6, which is moreover formed to automatically connect the supply lines 37, 46 and return lines 38, 47 or the connectors 48, 49, respectively, to a hydraulic supply system of the construction machine 3 during the mechanical fastening of the cable drum support 2 to the construction machine 3. It is thus not a mechanical, but also a hydraulic coupling of the cable drum support 2 to the construction machine 3, which takes place in an automated manner. Alternatively, the hydraulic lines of the hydraulic systems 23, 43 are to be connected manually to the hydraulic supply system of the construction machine 3 by a user.

The invention claimed is:

1. A cable drum support for rotatably supporting a cable drum, comprising:

a cross beam, on which two holding arms are arranged, which are aligned parallel to one another, wherein each holding arm has a respective laterally protruding and rotatably supported bearing pin on a free end, wherein the bearing pins are arranged aligned with one another on the holding arms so as to face one another and aligned parallel to the cross beam, and wherein at least one of the holding arms is shiftably supported along the cross beam, and at least one actuatable actuator, which is formed to shift at least the one of the holding arms and/or to apply a torque to at least one bearing pin for rotating about its longitudinal central axis, wherein a first actuator is arranged on the cross beam and is operatively connected to at least one of the holding arms, for the purpose of shifting the at least one of the holding arms, wherein a first actuator is assigned to each of the holding arms, respectively, for the shifting thereof, wherein at least one second actuator is operatively connected to the at least one bearing pin in order to apply a torque to the latter for rotating purposes, wherein the first actuator and the at least one second actuator are each formed as a hydraulic actuator, and wherein a first hydraulic system, which has a first hydraulic circuit comprising the first actuator and a second hydraulic circuit comprising the at least one second actuator and at least one switching valve, by means of which the first hydraulic circuit or the second hydraulic circuit can optionally be connected to a hydraulic connector, which can be connected to a hydraulic supply system.

2. The cable drum support according to claim 1, wherein the first actuator is formed as hydraulic cylinder.

3. The cable drum support according to claim 1, wherein the at least one second actuator is formed as hydraulic motor.

4. The cable drum support according to claim 1, wherein the hydraulic connector is arranged between the holding arms, viewed in the longitudinal extension of the cross beam.

5. The cable drum support according to claim 1, wherein an activatable coupling for releasable mechanical fastening of the cable drum support to a working machine arm, is arranged on the cross beam.

6. The cable drum support according to claim 5, wherein the coupling is formed to establish at least one hydraulic connection between the hydraulic supply system and the first and/or the second hydraulic system during the mechanical fastening of the cable drum support.

7. The cable drum support according to claim 1, wherein a second hydraulic system, which has a hydraulically drivable third actuator, wherein the activatable coupling is supported on the cross beam so as to be rotatable by means of a rotary joint, and wherein, in response to its actuation, the third actuator is formed to rotate the coupling relative to the cross beam.

8. The cable drum support according to claim 7, wherein the second hydraulic system has a hydraulic connection, which is assigned to the coupling.

9. The cable drum support according to claim 1, wherein the first hydraulic system has two switching valves, which connect the first hydraulic circuit to the hydraulic connector only when both switching valves are in a first one of two switching positions, and which connect the second hydraulic circuit to the hydraulic connector only when both switching valves are in a second one of the two switching positions.

10. The cable drum support according to claim 9, wherein the two switching valves are manual switching valves, wherein a respective handle of only one of the switching valves is arranged on the holding arms.

11. The cable drum support according to claim 1, wherein at least one manually operable throttle valve is arranged in the second hydraulic circuit.

12. The cable drum support according to claim 1, wherein an axial support disk for the axial support of a cable drum is in each case arranged in a rotationally fixed manner on the respective bearing pin.

13. The cable drum support according to claim 12, wherein the respective axial support disk has at least one elastically deformable stop element, arranged so as to be distributed evenly over the circumference of the axial support disk, for a cable drum.

* * * * *